US009064488B2

(12) United States Patent
Lang et al.

(10) Patent No.: US 9,064,488 B2
(45) Date of Patent: Jun. 23, 2015

(54) STEREO ENCODING METHOD, STEREO ENCODING DEVICE, AND ENCODER

(75) Inventors: Yue Lang, Munich (DE); Wenhai Wu, Beijing (CN); Lei Miao, Beijing (CN); Zexin Liu, Beijing (CN); Chen Hu, Shenzhen (CN); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 964 days.

(21) Appl. No.: 13/224,806

(22) Filed: Sep. 2, 2011

(65) Prior Publication Data

US 2011/0317843 A1 Dec. 29, 2011

Related U.S. Application Data

(63) Continuation of application No. PCT/CN2010/070873, filed on Mar. 4, 2010.

(30) Foreign Application Priority Data

Mar. 4, 2009 (CN) ..... 2009 1 0118870

(51) Int. Cl.
*H04R 5/00* (2006.01)
*G10L 19/008* (2013.01)
(Continued)

(52) U.S. Cl.
CPC ..... *G10L 19/008* (2013.01); *G10L 19/0204* (2013.01); *H04S 1/007* (2013.01)

(58) Field of Classification Search
CPC ..... G10L 19/008; H04S 3/02; H04R 5/00; H04R 5/02; H04R 5/033; H04H 20/48; H04H 20/88; H04H 20/89
USPC ..... 381/1, 17–23; 700/94; 704/500–504
See application file for complete search history.

(56) References Cited

U.S. PATENT DOCUMENTS 5,636,324 A 6/1997 Teh et al.
8,150,702 B2 * 4/2012 Zhou et al. ..... 704/503
(Continued)

FOREIGN PATENT DOCUMENTS

CN 101188878 A 5/2008
CN 101826326 A 9/2010
(Continued)

OTHER PUBLICATIONS

Supplementary European Search Report dated (mailed) Dec. 23, 2011, issued in related Application No. 10748324.2-2225, PCT/CN2010070873. Hauwei Technologies Co., Ltd.
(Continued)

*Primary Examiner* — Xu Mei
(74) *Attorney, Agent, or Firm* — Conley Rose, P.C.; Grant Rodolph; Nicholas K. Beaulieu

(57) ABSTRACT

A stereo encoding method, a stereo encoding device, and an encoder are provided. The stereo encoding method includes: obtaining a left channel energy relation coefficient and a right channel energy relation coefficient; obtaining a left energy sum and a right energy sum respectively; performing cross correlation between sub-bands of a first monophonic signal at a wave trough and sub-bands of the left channel signal according to the left channel energy relation coefficient, and performing cross correlation between sub-bands of the first monophonic signal at the wave trough and sub-bands of the right channel signal according to the right channel energy relation coefficient; obtaining a scaling factor by using the left energy sum, the right energy sum, and cross correlation results; and encoding the stereo left and right channel signals according to the scaling factor.

17 Claims, 4 Drawing Sheets

(51) Int. Cl.
*H04S 1/00* (2006.01)
*G10L 19/02* (2013.01)

(56) References Cited

U.S. PATENT DOCUMENTS

| | | | | |
|---|---|---|---|---|
| 8,190,425 | B2 * | 5/2012 | Mehrotra et al. | 704/203 |
| 8,254,585 | B2 * | 8/2012 | Schuijers et al. | 381/23 |
| 8,811,621 | B2 * | 8/2014 | Schuijers | 381/22 |
| 2005/0157884 | A1 * | 7/2005 | Eguchi | 381/23 |
| 2006/0190247 | A1 | 8/2006 | Lindblom | |
| 2008/0199014 | A1 | 8/2008 | Kurniawati et al. | |
| 2008/0204456 | A1 | 8/2008 | Sapp | |
| 2011/0299702 | A1 * | 12/2011 | Faller | 381/92 |

FOREIGN PATENT DOCUMENTS

JP 2003-228397 A 8/2003
WO WO 2008/016097 A1 2/2008

OTHER PUBLICATIONS

Baumgarte F et al: "Binaural cue coding-part II: schemes and applications" IEEE Transactions on Speech and Audio Processing, IEEE Service Center, New York, NY, US, vol. 11, No. 6, Nov. 1, 2003, pp. 520-531, XP011104739, ISSN: 1063-6676, DOI: 10. 1109/TSA. 2003.818109.

International Search Report in International Application No. PCT/CN2010/070873 mailed Jun. 10, 2010.

Ericsson, et al., "Updated High Level Description (CuTA)", Confidential according to Q23_SWB9p collaboration agreement: https://132.210.72.248/users/Q23_swb9p/LL/SignedCollaborationAgreement, pp. 1-17, (2008).

Written Opinion of the International Searching Authority in International Application No. PCT/CN2010/070873 mailed Jun. 10, 2010.

* cited by examiner

STEREO ENCODING METHOD, STEREO ENCODING DEVICE, AND ENCODER

CROSS-REFERENCE TO RELATED APPLICATION

This application is a continuation of International Application No. PCT/CN2010/070873, filed on Mar. 4, 2010, which claims priority to Chinese Patent Application No. 200910118870.8, filed on Mar. 4, 2009, both of which are hereby incorporated by reference in their entireties.

FIELD OF THE INVENTION

The present invention relates to the field of communication technologies, and in particular, to a stereo encoding method, a stereo encoding device, and an encoder.

BACKGROUND OF THE INVENTION

In the stereo encoding technology, a left channel signal and a right channel signal are downmixed into a first monophonic signal, energy relations between the first monophonic signal and the left and the right channel signals are encoded, the first monophonic signal is adjusted to obtain a second monophonic signal, and differences between the second monophonic signal and the left channel signal and between the second monophonic signal and the right channel signal are encoded respectively. The information may be used to reconstruct audio signals at the decoding end to obtain a good stereo effect.

In the existing stereo encoding technology, the first monophonic signal needs to be adjusted only when a scaling factor is determined. In order to determine an optimal scaling factor, all possible scaling factors are calculated and compared in the prior art. Therefore, high calculation amount and complexity are required, and many system resources are occupied.

SUMMARY OF THE INVENTION

Embodiments of the present invention provide a stereo encoding method, a stereo encoding device, and an encoder, so as to reduce the complexity of determining a scaling factor, and the required calculation amount and complexity, thereby reducing the system resources to a great extent.

To achieve the objective, the embodiments of the present invention adopt the following technical solutions.

In one aspect, an embodiment of the present invention provides a stereo encoding method, including:

obtaining a left channel energy relation coefficient between a first monophonic signal and a left channel signal and a right channel energy relation coefficient between the first monophonic signal and a right channel signal, in which the first monophonic signal is generated by mixing stereo left and right channel signals;

obtaining a left energy sum of sub-bands of the first monophonic signal at a wave trough that are corresponding to the left channel energy relation coefficient and a right energy sum of the sub-bands of the first monophonic signal at the wave trough that are corresponding to the right channel energy relation coefficient respectively;

performing cross correlation between the sub-bands of the first monophonic signal at the wave trough and sub-bands of the left channel signal according to the left channel energy relation coefficient, and performing cross correlation between the sub-bands of the first monophonic signal at the wave trough and sub-bands of the right channel signal according to the right channel energy relation coefficient, so as to obtain cross correlation results;

obtaining a scaling factor by using the left energy sum, the right energy sum, and the cross correlation results; and encoding the stereo left and right channel signals according to the scaling factor.

In another aspect, an embodiment of the present invention provides a stereo encoding device, including:

an energy relation obtaining module, configured to obtain a left channel energy relation coefficient between a first monophonic signal and a left channel signal and a right channel energy relation coefficient between the first monophonic signal and a right channel signal, in which the first monophonic signal is generated by mixing stereo left and right channel signals;

an energy sum obtaining module, configured to obtain a left energy sum of sub-bands of the first monophonic signal at a wave trough that are corresponding to the left channel energy relation coefficient generated by the energy relation obtaining module and a right energy sum of the sub-bands of the first monophonic signal at the wave trough that are corresponding to the right channel energy relation coefficient generated by the energy relation obtaining module respectively;

a cross correlation module, configured to perform cross correlation between the sub-bands of the first monophonic signal at the wave trough and sub-bands of the left channel signal according to the left channel energy relation coefficient obtained by the energy relation obtaining module, and perform cross correlation between the sub-bands of the first monophonic signal at the wave trough and sub-bands of the right channel signal according to the right channel energy relation coefficient obtained by the energy relation obtaining module, so as to obtain cross correlation results;

a scaling factor obtaining module, configured to obtain a scaling factor according to the left energy sum and the right energy sum generated by the energy sum obtaining module and the cross correlation results generated by the cross correlation module; and an encoding module, configured to encode the stereo left and right channel signals according to the scaling factor.

In still another aspect, an embodiment of the present invention provides an encoder, including:

an energy relation obtaining module, configured to obtain a left channel energy relation coefficient between a first monophonic signal and a left channel signal and a right channel energy relation coefficient between the first monophonic signal and a right channel signal, in which the first monophonic signal is generated by mixing stereo left and right channel signals;

an energy sum obtaining module, configured to obtain a left energy sum of sub-bands of the first monophonic signal at a wave trough that are corresponding to the left channel energy relation coefficient generated by the energy relation obtaining module and a right energy sum of the sub-bands of the first monophonic signal at the wave trough that are corresponding to the right channel energy relation coefficient generated by the energy relation obtaining module respectively;

a cross correlation module, configured to perform cross correlation between the sub-bands of the first monophonic signal at the wave trough and sub-bands of the left channel signal according to the left channel energy relation coefficient obtained by the energy relation obtaining module, and perform cross correlation between the sub-bands of the first monophonic signal at the wave trough and sub-bands of the right channel signal according to the right channel energy relation coefficient obtained by the energy relation obtaining module, so as to obtain cross correlation results;

a scaling factor obtaining module, configured to obtain a scaling factor according to the left energy sum and the right energy sum generated by the energy sum obtaining module and the cross correlation results generated by the cross correlation module; and an encoding module, configured to encode the stereo left and right channel signals according to the scaling factor.

The stereo encoding method, the stereo encoding device, and the encoder according to the embodiments of the present invention reduce the complexity of determining a scaling factor, and, compared with the prior art, reduce the calculation amount and complexity of the stereo encoding, reducing the system resources to a great extent.

DETAILED DESCRIPTION OF THE EMBODIMENTS

To make the objectives, technical solutions, and advantages of the present invention more comprehensible, embodiments of the present invention are further described below in detail with reference to the accompanying drawings.

Figure 1:
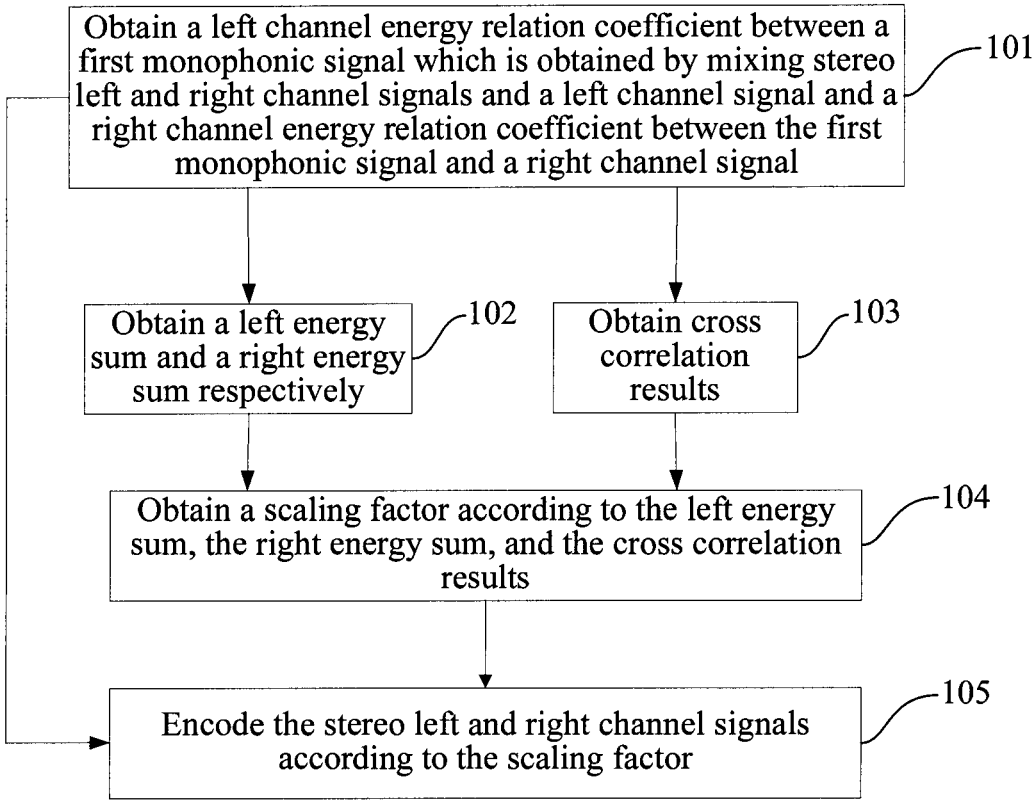
FIG. 1 is a flow chart of a stereo encoding method according to Embodiment 1 of the present invention.

As shown in FIG. 1, Embodiment 1 of the present invention provides a stereo encoding method, including the following steps.

Step 101: Obtain a left channel energy relation coefficient between a first monophonic signal and a left channel signal and a right channel energy relation coefficient between the first monophonic signal and a right channel signal, in which the first monophonic signal is generated by downmixing stereo left and right channel signals.

In the embodiments of the present invention, left and right channel signals are first downmixed into one monophonic signal, the monophonic signal is converted to a Modified Discrete Cosine Transform (MDCT) domain, the monophonic signal in the MDCT domain is encoded, and then local decoding is performed, so as to obtain a monophonic monoc signal which is a first monophonic signal; and energy relation (panning) coefficients between the first monophonic signal and the left and right channel signals are calculated respectively. The energy relation coefficients include a left channel energy relation coefficient and a right channel energy relation coefficient.

Step 102: Obtain a left energy sum of the sub-bands of the first monophonic signal at a wave trough that are corresponding to the left channel energy relation coefficient and a right energy sum of the sub-bands of the first monophonic signal at the wave trough that are corresponding to the right channel energy relation coefficient, respectively.

The left energy sum, that is, the energy sum ml_e of the product of the first monophonic signal at the wave trough and the left channel energy relation coefficient, is obtained with the following formula:

$$\mathrm{ml_e} = \sum_n (m(n) * wl)^2$$

Where, m(n) is the monophonic signal at the wave trough, and wl is the left channel energy relation coefficient corresponding to a sub-band at the wave trough.

The right energy sum, that is, the energy sum mr_e of the product of the first monophonic signal at the wave trough and the right channel energy relation coefficient, is obtained with the following formula:

$$\mathrm{mr_e} = \sum_n (m(n) * wr)^2$$

Where, m(n) is the monophonic signal at the wave trough, and wr is the right channel energy relation coefficient corresponding to a sub-band at the wave trough.

Step 103: Perform cross correlation between the sub-bands of the first monophonic signal at the wave trough and the sub-bands of the left channel signal according to the left channel energy relation coefficient, and perform cross correlation between the sub-bands of the first monophonic signal at the wave trough and the sub-bands of the right channel signal is performed according to the right channel energy relation coefficient, so as to obtain cross correlation results.

The cross correlation between the sub-bands of the first monophonic signal at the wave trough and the sub-bands of the left channel signal is performed according to the left channel energy relation coefficient, so as to obtain a left cross correlation result l_m with the following formula:

$$\mathrm{l_m} = \sum_n m(n) * wl * l(n),$$

where, m(n) is the monophonic signal at the wave trough, wl is the left channel energy relation coefficient corresponding to a sub-band at the wave trough, and l(n) is the left channel signal at the wave trough.

The cross correlation between the sub-bands of the first monophonic signal at the wave trough and the sub-bands of the right channel signal is performed according to the right channel energy relation coefficient, so as to obtain a right cross correlation result r_m with the following formula:

$$\mathrm{r_m} = \sum_n m(n) * wr * r(n),$$

where, m(n) is the monophonic signal at the wave trough, wr is the right channel energy relation coefficient corresponding to a sub-band at the wave trough, and r(n) is the right channel signal at the wave trough.

Step 104: Obtain a scaling factor by using the left energy sum, the right energy sum, and the cross correlation results.

The ml_e, mr_e, l_m, and r_m obtained through calculation in Steps 102 and 103 are substituted into the following formula, so as to calculate and obtain the value mult of the scaling factor:

$$mult = \frac{\text{l_m} + \text{r_m}}{\text{ml_e} + \text{mr_e}}$$

Step 105: Encode the stereo left and right channel signals according to the scaling factor.

The scaling factor and the energy relation (panning) coefficients are used to adjust the first monophonic signal, so as to obtain a second monophonic signal which includes a second monophonic left signal and a second monophonic right signal; and the difference between the left channel signal and the second monophonic left signal and the difference between the right channel signal and the second monophonic right signal are encoded respectively.

In the stereo encoding method according to Embodiment 1 of the present invention, the scaling factor is directly calculated by using the energy sums of the products of the monophonic signal at the wave trough and the left channel energy relation coefficient and the right channel energy relation coefficient and the cross correlation values between the monophonic signal at the wave trough and the left and right channel signals, which greatly reduces the complexity of determining the scaling factor in the prior art, thereby reducing the calculation amount and complexity of the stereo encoding on the whole and saving the system resources significantly.

The scaling factor obtained through calculation in Embodiment 1 of the present invention can be directly used in the adjustment process for the first monophonic signal. To achieve a better adjustment effect, Embodiment 2 of the present invention provides a more accurate method for determining an optimal scaling factor. Since all the other steps are the same as those in Embodiment 1 of the present invention, only the method for determining an optimal scaling factor in Embodiment 2 of the present invention is described below.

Figure 2:
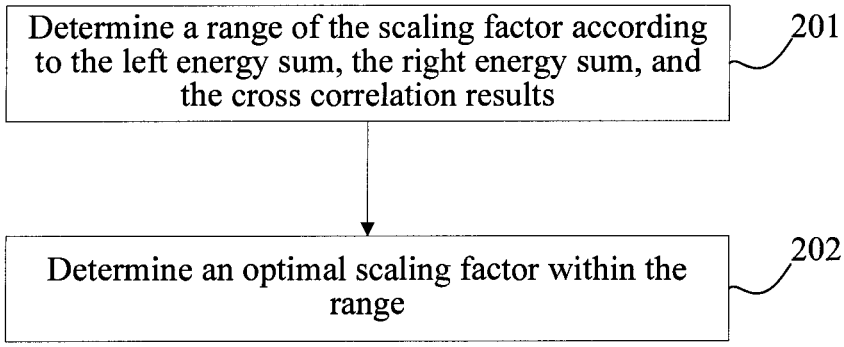
FIG. 2 is a flow chart of a step of determining an optimal scaling factor according to Embodiment 2 of the present invention.

As shown in FIG. 2, the step of determining an optimal scaling factor according to Embodiment 2 of the present invention includes:

step 201: Determine a range of the scaling factor according to the left energy sum, the right energy sum, and the cross correlation results; and step 202: Determine an optimal scaling factor within the range.

An optimal scaling factor is selected from all scaling factors within the range in a codebook. The above steps are described below respectively in detail with reference to the accompanying drawings.

Figure 3:
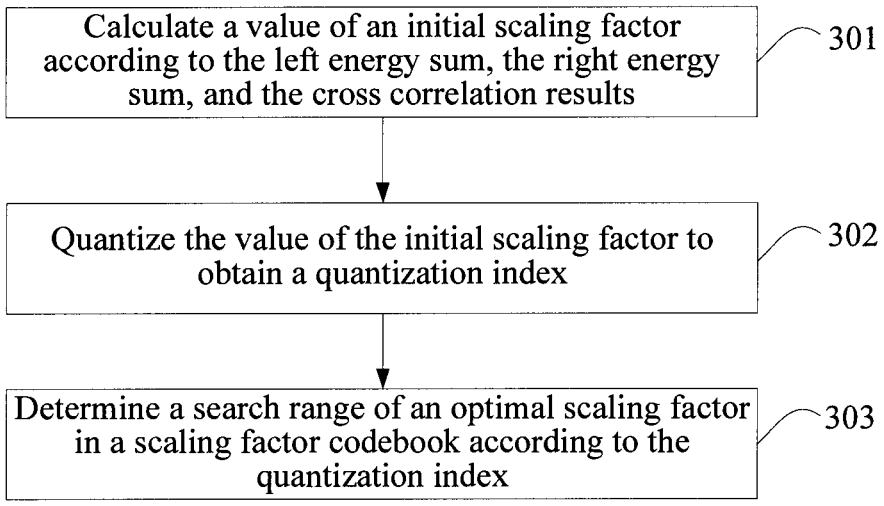
FIG. 3 is a flow chart of a step of determining a range of the scaling factor according to the left energy sum, the right energy sum, and the cross correlation results according to Embodiment 2 of the present invention.

As shown in FIG. 3, in Embodiment 2 of the present invention, the step of determining the range of the scaling factor according to the left energy sum, the right energy sum, and the cross correlation results includes the following steps.

Step 301: Calculate a value of an initial scaling factor according to the left energy sum, the right energy sum, and the cross correlation results.

The ml_e, mr_e, l_m, and r_m obtained through calculation in Steps 102 and 103 are substituted into the following formula to calculate and obtain the value mult of the initial scaling factor:

$$mult = \frac{\text{l_m} + \text{r_m}}{\text{ml_e} + \text{mr_e}}$$

Step 302: Quantize the value of the initial scaling factor to obtain a quantization index.

The value of the initial scaling factor is quantized by using a scaling factor quantizer, so as to obtain the quantization index of the initial scaling factor.

Step 303: Determine a search range of an optimal scaling factor in a scaling factor codebook according to the quantization index.

In the scaling factor codebook, all the scaling factors are arranged in ascending order of quantization indexes corresponding to the scaling factors, and therefore, it can be determined that the optimal scaling factor is one of the obtained initial scaling factor, the scaling factor corresponding to the quantization index of the initial scaling factor minus one, and the scaling factor corresponding to the quantization index of the initial scaling factor plus one.

Alternatively, the search range may also be set in the following manner. First, the one of the scaling factor corresponding to the quantization index of the initial scaling factor minus one and the scaling factor corresponding to the quantization index of the initial scaling factor plus one which is the closest to the initial scaling factor (that is, one with the minimum absolute value of the difference from the initial scaling factor) is found, and, together with the initial scaling factor, serves as a search range of the scaling factor.

If the quantization index of the initial scaling factor is the minimum index in the codebook, the optimal scaling factor is one of the obtained initial scaling factor and the scaling factor corresponding to the quantization index of the initial scaling factor plus one.

If the quantization index of the initial scaling factor is the maximum index in the codebook, the optimal scaling factor is one of the obtained initial scaling factor and the scaling factor corresponding to the quantization index of the initial scaling factor minus one.

Figure 4:
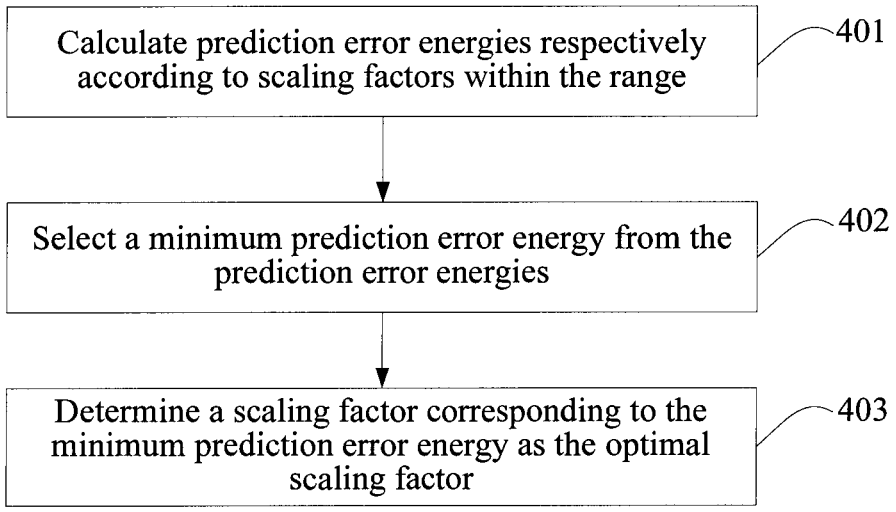
FIG. 4 is a flow chart of a step of determining an optimal scaling factor within the range according to Embodiment 2 of the present invention.

As shown in FIG. 4, in Embodiment 2 of the present invention, the step of determining an optimal scaling factor within the range includes the following steps.

Step 401: Calculate prediction error energies respectively according to scaling factors within the range.

The scaling factors within the range are respectively substituted into the following formula, so as to calculate the prediction error energy, dist, corresponding to each scaling factor:

$$dist = \sum_n (l(n) - wl * M(n))^2 + (r(n) - wr * M(n))^2$$

where l(n) is the left channel signal at the wave trough, r(n) is the right channel signal at the wave trough, wl is the left channel energy relation coefficient corresponding to a sub-band at the wave trough, wr is the right channel energy relation coefficient corresponding to a sub-band at the wave trough, and M(n) is the product of the first monophonic signal m(n) at the wave trough and the scaling factor.

Step 402: Select the minimum prediction error energy from the prediction error energies.

The prediction error energies obtained according to the above formula are arranged in order, so as to obtain the minimum prediction error energy.

Step 403: A scaling factor corresponding to the minimum prediction error energy is the optimal scaling factor.

A scaling factor which is used in calculating and obtaining the minimum prediction error energy is found, and the scaling factor is the optimal scaling factor.

In Embodiment 2 of the present invention, a search range of the scaling factor is determined, and then an optimal scaling factor is selected from the scaling factors within the search range, which, compared with the prior art, reduces the complexity of determining the scaling factor, thereby reducing the calculation amount and complexity of the stereo encoding on the whole and saving the system resources significantly.

In the process of calculating an initial scaling factor according to Embodiment 2 of the present invention, it is necessary to use the left and right channel energy relation coefficients. In the process of calculating an initial scaling factor according to Embodiment 3 of the present invention, the left and right channel energy relation coefficients can be set to 1, so as to calculate the initial scaling factor and finally determine the optimal scaling factor.

In the process of calculating an initial scaling factor according to Embodiment 4 of the present invention, the left channel energy relation coefficient can be set to the average of left channel energy relation coefficients in a band, and the right channel energy relation coefficient can be set to the average of right channel energy relation coefficients in the band, so as to calculate the initial scaling factor and finally determine the optimal scaling factor.

Embodiment 3 and Embodiment 4 of the present invention are different from Embodiment 1 of the present invention only in the selection of the left and right channel energy relation coefficients, and the other steps in Embodiment 3 and Embodiment 4 of the present invention are the same as those in Embodiment 1 of the present invention, which are therefore not repeated.

Figure 5:
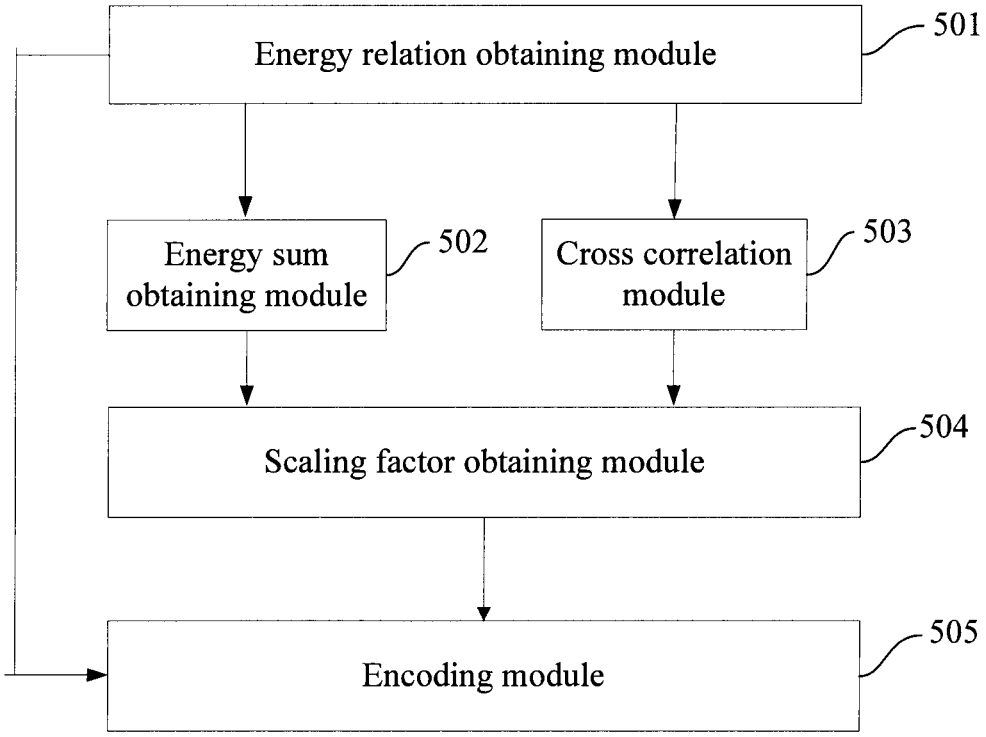
FIG. 5 is a structural diagram of a stereo encoding device according to Embodiment 5 of the present invention.

Based on the above method embodiments, Embodiment 5 of the present invention provides a stereo encoding device. As shown in FIG. 5, the device includes:

an energy relation obtaining module 501, configured to obtain a left channel energy relation coefficient between a first monophonic signal and a left channel signal and a right channel energy relation coefficient between the first monophonic signal and a right channel signal, in which the first monophonic signal is generated by downmixing stereo left and right channel signals;

an energy sum obtaining module 502, configured to obtain a left energy sum of sub-bands of the first monophonic signal at a wave trough that are corresponding to the left channel energy relation coefficient generated by the energy relation obtaining module 501 and a right energy sum of the sub-bands of the first monophonic signal at the wave trough that are corresponding to the right channel energy relation coefficient generated by the energy relation obtaining module 501 respectively;

a cross correlation module 503, configured to perform cross correlation between the sub-bands of the first monophonic signal at the wave trough and sub-bands of the left channel signal according to the left channel energy relation coefficient obtained by the energy relation obtaining module 502, and perform cross correlation between the sub-bands of the first monophonic signal at the wave trough and sub-bands of the right channel signal according to the right channel energy relation coefficient obtained by the energy relation obtaining module 502, so as to obtain cross correlation results;

a scaling factor obtaining module 504, configured to obtain a value of a scaling factor according to the left energy sum and the right energy sum generated by the energy sum obtaining module 502 and the left and right cross correlation results generated by the cross correlation module 503; and an encoding module 505, configured to encode the stereo left and right channel signals according to the scaling factor obtained by the scaling factor obtaining module 504.

In the stereo encoding device according to Embodiment 5 of the present invention, the scaling factor is directly calculated by using the energy sums of the products of the monophonic signal at the wave trough and the left and right channel energy relation coefficients and the cross correlation values between the monophonic signal at the wave trough and the left and right channel signals, which greatly reduces the complexity of determining the scaling factor in the prior art, thereby reducing the calculation amount and complexity of the stereo encoding on the whole and saving the system resources significantly.

Figure 6:
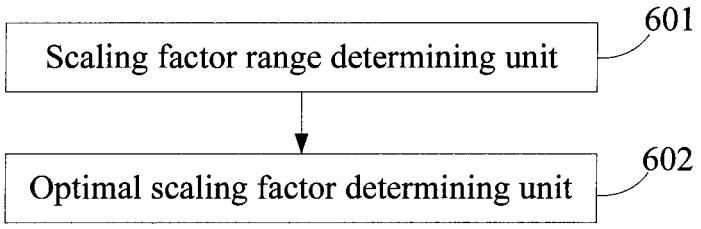
FIG. 6 is a structural diagram of a scaling factor obtaining module according to Embodiment 5 of the present invention.

The scaling factor obtained through calculation in the scaling factor obtaining module 504 may be directly used in the encoding module 505 to encode the stereo left and right channel signals. To achieve a better effect, in Embodiment 6 of the present invention, as shown in FIG. 6, the scaling factor obtaining module 504 includes:

a scaling factor range determining unit 601, configured to determine a range of the scaling factor according to the left energy sum and the right energy sum generated by the energy sum obtaining module 502 and the cross correlation results generated by the cross correlation module 503; and an optimal scaling factor determining unit 602, configured to determine an optimal scaling factor within the range determined by the scaling factor range determining unit 601.

Figure 7:
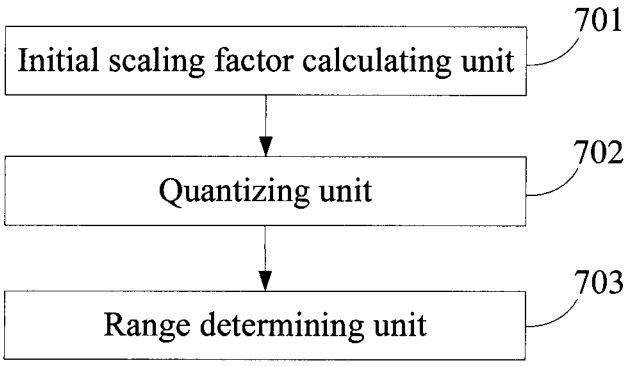
FIG. 7 is a structural diagram of a scaling factor range determining unit according to Embodiment 6 of the present invention.

As shown in FIG. 7, in Embodiment 6 of the present invention, the scaling factor range determining unit 601 includes:

an initial scaling factor calculating unit 701, configured to calculate a value of an initial scaling factor according to the left energy sum and the right energy sum generated by the energy sum obtaining module and the cross correlation results generated by the cross correlation module;

a quantizing unit 702, configured to quantize the value of the initial scaling factor obtained by the initial scaling factor calculating unit 701 to obtain a quantization index; and a range determining unit 703, configured to determine a search range of the scaling factor in a scaling factor codebook according to the quantization index obtained by the quantizing unit 702.

Figure 8:
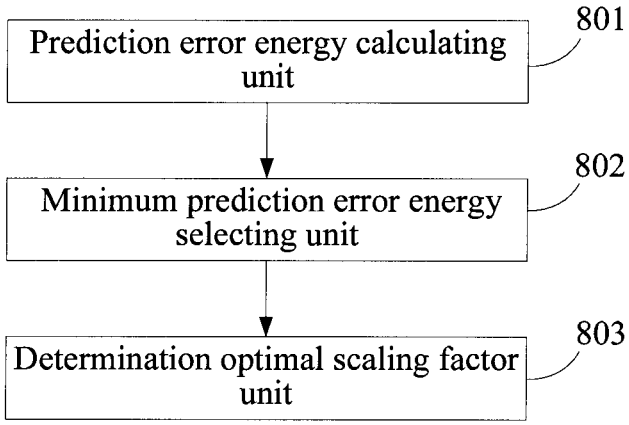
FIG. 8 is a structural diagram of an optimal scaling factor determining unit according to Embodiment 6 of the present invention.

As shown in FIG. 8, in Embodiment 6 of the present invention, the optimal scaling factor determining unit 602 includes:

a prediction error energy calculating unit 801, configured to calculate prediction error energies respectively according to scaling factors within the range;

a minimum prediction error energy selecting unit 802, configured to select a minimum prediction error energy from the prediction error energies obtained by the prediction error energy calculating unit 801; and a determination optimal scaling factor unit 803, configured to determine a scaling factor corresponding to the minimum prediction error energy selected by the minimum prediction error energy selecting unit 802 as the optimal scaling factor.

In the stereo encoding device according to Embodiment 6 of the present invention, a search range of the scaling factor is determined, and then an optimal scaling factor is selected from the scaling factors in the search range, which, compared with the prior art, reduces the complexity of determining the scaling factor, thereby reducing the calculation amount and complexity of the stereo encoding on the whole and saving the system resources significantly.

Embodiment 7 of the present invention provides an encoder, including:

an energy relation obtaining module 501, configured to obtain a left channel energy relation coefficient between a first monophonic signal and a left channel signal and a right channel energy relation coefficient between the first monophonic signal and a right channel signal, in which the first monophonic signal is generated by downmixing stereo left and right channel signals;

an energy sum obtaining module 502, configured to obtain a left energy sum of sub-bands of the first monophonic signal at a wave trough that are corresponding to the left channel energy relation coefficient generated by the energy relation obtaining module 501 and a right energy sum of the sub-bands of the first monophonic signal at the wave trough that are corresponding to the right channel energy relation coefficient generated by the energy relation obtaining module 501 respectively;

a cross correlation module 503, configured to perform cross correlation between the sub-bands of the first monophonic signal at the wave trough and sub-bands of the left channel signal according to the left channel energy relation coefficient obtained by the energy relation obtaining module 502, and perform cross correlation between the sub-bands of the first monophonic signal at the wave trough and sub-bands of the right channel signal according to the right channel energy relation coefficient obtained by the energy relation obtaining module 502, so as to obtain cross correlation results;

a scaling factor obtaining module 504, configured to obtain a value of a scaling factor according to the left energy sum and the right energy sum generated by the energy sum obtaining module 502 and the left and right cross correlation results generated by the cross correlation module 503; and an encoding module 505, configured to encode the stereo left and right channel signals according to the scaling factor obtained by the scaling factor obtaining module 504.

The encoder according to Embodiment 7 of the present invention greatly reduces the complexity of determining the scaling factor in the prior art, thereby reducing the calculation amount and complexity of the stereo encoding on the whole and saving the system resources significantly.

Embodiment 8 of the present invention provides a stereo encoding method, including the following steps.

Step 601: Obtain an energy sum of a predicted value of a left channel signal at a wave trough by using a monophonic signal and a left channel energy relation coefficient, and obtain an energy sum of a predicted value of a right channel signal at the wave trough by using the monophonic signal and a right channel energy relation coefficient, in which the monophonic signal is obtained by downmixing stereo left and right channel signals.

A left channel energy relation coefficient between a first monophonic signal and a left channel signal and a right channel energy relation coefficient between the first monophonic signal and a right channel signal are obtained, in which the first monophonic signal is obtained by downmixing stereo left and right channel signals; and the energy sum of the predicted value of the left channel signal at the wave trough and the energy sum of the right channel signal at the wave trough are obtained respectively.

The energy sums, that is, the energy sum ml_e of the product of the monophonic signal at the wave trough and the left channel energy relation coefficient, and the energy sum mr_e of the product of the monophonic signal at the wave trough and the right channel energy relation coefficient, are obtained with the following formula:

$$\text{ml_e} = \sum_n (m(n) * wl)^2, \text{ and } \text{mr_e} = \sum_n (m(n) * wr)^2,$$

where m(n) is the monophonic signal at the wave trough, wl is the left channel energy relation coefficient corresponding to a sub-band at the wave trough, and wr is the right channel energy relation coefficient corresponding to a sub-band at the wave trough.

Step 602: Obtain a cross correlation result between the predicted value of the left channel signal at the wave trough and the left channel signal by using the monophonic signal and the left channel energy relation coefficient, and obtain a cross correlation result between the predicted value of the right channel signal at the wave trough and the right channel signal by using the monophonic signal and the right channel energy relation coefficient.

The monophonic signal is multiplied by the left channel energy relation coefficient to obtain the predicted value of the left channel signal, and the monophonic signal is multiplied by the right channel energy relation coefficient to obtain the predicted value of the right channel signal; and a sum of correlation values between the predicted value of the left channel signal at the wave trough and sub-bands of the left channel signal is obtained according to the predicted value of the left channel signal, and a sum of correlation values between the predicted value of the right channel signal at the wave trough and sub-bands of the right channel signal is obtained according to the predicted value of the right channel signal, that is, the sum of the correlation values between the predicted value of the left channel signal at the wave trough and the sub-bands of the left channel signal is calculated, and the sum of the correlation values between the predicted value of the right channel signal at the wave trough and the sub-bands of the right channel signal is calculated, so as to obtain cross correlation results. The predicted value of the left channel signal is the product of the monophonic signal and the left channel energy relation coefficient, and the predicted value of the right channel signal is the product of the monophonic signal and the right channel energy relation coefficient.

The above may be represented by the following formulae:

$$\text{l_m} = \sum_n m(n) * wl * l(n) \text{ and } \text{r_m} = \sum_n m(n) * wr * r(n),$$

where m(n) is the monophonic signal at the wave trough, wl is the left channel energy relation coefficient corresponding to a sub-band at the wave trough, l(n) is the left channel signal at the wave trough, wr is the right channel energy relation coefficient corresponding to the sub-band at the wave trough, and r(n) is the right channel signal at the wave trough.

Step 603: Obtain a scaling factor by using the energy sums and the cross correlation results.

A value of an initial scaling factor is calculated according to the energy sums and the cross correlation results, the value of the initial scaling factor is quantized to obtain a quantization index, a search range of a scaling factor is determined in a scaling factor codebook according to the quantization index, and an optimal scaling factor is determined within the range. The determining of the optimal scaling factor within the range includes: calculating prediction error energies respectively according to scaling factors within the range, selecting a minimum prediction error energy from the prediction error energies, and determining a scaling factor corresponding to the minimum prediction error energy as the optimal scaling factor.

Step 604: Encode the stereo left and right channel signals according to the scaling factor.

Steps 603 and 604 are the same as those in the above method embodiments.

Persons of ordinary skill in the art should understand that all or part of the steps of the method according to the embodiments of the present invention may be completed by a program instructing relevant hardware, and the program may be stored in a computer readable storage medium, such as a ROM/RAM, a magnetic disk, or an optical disk.

The above descriptions are merely specific embodiments of the present invention, but not intended to limit the protection scope of the present invention. Any variations or replacements that may be easily thought of by persons skilled in the art without departing from the technical scope of the present invention should fall within the protection scope of the present invention. Therefore, the protection scope of the present invention shall be defined by the appended claims.

What is claimed is:

1. A stereo encoding method, comprising:

obtaining a left channel energy relation coefficient between a first monophonic signal and a left channel signal and a right channel energy relation coefficient between the first monophonic signal and a right channel signal, wherein the first monophonic signal is generated by downmixing stereo left and right channel signals;

obtaining a left energy sum of sub-bands of the first monophonic signal at a wave trough that are corresponding to the left channel energy relation coefficient and a right energy sum of the sub-bands of the first monophonic signal at the wave trough that are corresponding to the right channel energy relation coefficient respectively;

performing cross correlation between the sub-bands of the first monophonic signal at the wave trough and sub-bands of the left channel signal according to the left channel energy relation coefficient, and performing cross correlation between the sub-bands of the first monophonic signal at the wave trough and sub-bands of the right channel signal according to the right channel energy relation coefficient, so as to obtain cross correlation results;

obtaining a scaling factor by using the left energy sum, the right energy sum, and the cross correlation results; and encoding the stereo left and right channel signals according to the scaling factor.

2. The stereo encoding method according to claim 1, wherein the step of obtaining the scaling factor according to the left energy sum, the right energy sum, and the cross correlation results comprises:

determining a range of the scaling factor according to the left energy sum, the right energy sum, and the cross correlation results; and determining an optimal scaling factor within the range.

3. The stereo encoding method according to claim 2, wherein the step of determining the range of the scaling factor according to the left energy sum, the right energy sum, and the cross correlation results comprises:

calculating a value of an initial scaling factor according to the left energy sum, the right energy sum, and the cross correlation results;

quantizing the value of the initial scaling factor to obtain a quantization index; and determining a search range of the scaling factor in a scaling factor codebook according to the quantization index.

4. The stereo encoding method according to claim 3, wherein the step of determining the optimal scaling factor within the range comprises:

calculating prediction error energies respectively according to scaling factors within the range;

selecting a minimum prediction error energy from the prediction error energies; and determining a scaling factor corresponding to the minimum prediction error energy as the optimal scaling factor.

5. The stereo encoding method according to claim 4, wherein both the left channel energy relation coefficient and the right channel energy relation coefficient are 1.

6. The stereo encoding method according to claim 4, wherein the left channel energy relation coefficient is an average of left channel energy relation coefficients in a band, and the right channel energy relation coefficient is an average of right channel energy relation coefficients in the band.

7. A stereo encoding device, comprising:

an energy relation obtaining module, configured to obtain a left channel energy relation coefficient between a first monophonic signal and a left channel signal and a right channel energy relation coefficient between the first monophonic signal and a right channel signal, wherein the first monophonic signal is generated by mixing stereo left and right channel signals;

an energy sum obtaining module, configured to obtain a left energy sum of sub-bands of the first monophonic signal at a wave trough that are corresponding to the left channel energy relation coefficient generated by the energy relation obtaining module and a right energy sum of the sub-bands of the first monophonic signal at the wave trough that are corresponding to the right channel energy relation coefficient generated by the energy relation obtaining module respectively;

a cross correlation module, configured to perform cross correlation between the sub-bands of the first monophonic signal at the wave trough and sub-bands of the left channel signal according to the left channel energy relation coefficient obtained by the energy relation obtaining module, and perform cross correlation between the sub-bands of the first monophonic signal at the wave trough and sub-bands of the right channel signal according to the right channel energy relation coefficient obtained by the energy relation obtaining module, so as to obtain cross correlation results;

a scaling factor obtaining module, configured to obtain a scaling factor according to the left energy sum and the right energy sum generated by the energy sum obtaining module and the cross correlation results generated by the cross correlation module; and an encoding module, configured to encode the stereo left and right channel signals according to the scaling factor obtained by the scaling factor obtaining module.

8. The stereo encoding device according to claim 7, wherein the scaling factor obtaining module comprises:

a scaling factor range determining unit, configured to determine a range of the scaling factor according to the left energy sum and the right energy sum generated by the energy sum obtaining module and the cross correlation results generated by the cross correlation module; and an optimal scaling factor determining unit, configured to determine an optimal scaling factor within the range determined by the scaling factor range determining unit.

9. The stereo encoding device according to claim 8, wherein the scaling factor range determining unit comprises:

an initial scaling factor calculating unit, configured to calculate a value of an initial scaling factor according to the left energy sum and the right energy sum generated by the energy sum obtaining module and the cross correlation results generated by the cross correlation module;

a quantizing unit, configured to quantize the value of the initial scaling factor obtained by the initial scaling factor calculating unit to obtain a quantization index; and a range determining unit, configured to determine a search range of the scaling factor in a scaling factor codebook according to the quantization index obtained by the quantizing unit.

10. The stereo encoding device according to claim 8, wherein the optimal scaling factor determining unit comprises:

a prediction error energy calculating unit, configured to calculate prediction error energies respectively according to scaling factors within the range;

a minimum prediction error energy selecting unit, configured to select a minimum prediction error energy from the prediction error energies obtained by the prediction error energy calculating unit; and a determination optimal scaling factor unit, configured to determine a scaling factor corresponding to the minimum prediction error energy selected by the minimum prediction error energy selecting unit as the optimal scaling factor.

11. An encoder, comprising the stereo encoding device according to claim 7.

12. A stereo encoding method, comprising:

obtaining energy sums of predicted values of left and right channel signals at a wave trough by using a first monophonic signal and left and right channel energy relation coefficients respectively, wherein the first monophonic signal is obtained by downmixing stereo left and right channel signals;

obtaining cross correlation results between the predicted value of the left channel signal at the wave trough and the left channel signal and between the predicted value of the right channel signal at the wave trough and the right channel signal, by using the first monophonic signal and the left and right channel energy relation coefficients respectively;

obtaining a scaling factor by using the energy sums of the predicted values of the left and right channel signals and the cross correlation results between the predicted value of the left channel signal and the left channel signal and between the predicted value of the right channel signal and the right channel signal; and encoding the stereo left and right channel signals according to the scaling factor.

13. The stereo encoding method according to claim 12, wherein the obtaining the cross correlation results between the predicted value of the left channel signal at the wave trough and the left channel signal and between the predicted value of the right channel signal at the wave trough and the right channel signal, by using the first monophonic signal and the left and right channel energy relation coefficients respectively comprises:

multiplying the first monophonic signal by the left channel energy relation coefficient to obtain the predicted value of the left channel signal, and multiplying the first monophonic signal by the right channel energy relation coefficient to obtain the predicted value of the right channel signal; and obtaining a sum of correlation values between the predicted value of the left channel signal at the wave trough and sub-bands of the left channel signal according to the predicted value of the left channel signal, and obtaining a sum of correlation values between the predicted value of the right channel signal at the wave trough and sub-bands of the right channel signal according to the predicted value of the right channel signal.

14. The stereo encoding method according to claim 13, wherein the obtaining the cross correlation results between the predicted value of the left channel signal at the wave trough and the left channel signal and between the predicted value of the right channel signal at the wave trough and the right channel signal, by using the first monophonic signal and the left and right channel energy relation coefficients respectively comprises:

$$\text{ml_e} = \sum_n (m(n) * wl)^2 \text{ and } \text{mr_e} = \sum_n (m(n) * wr)^2,$$

where m(n) is the first monophonic signal at the wave trough, wl is the left channel energy relation coefficient corresponding to a sub-band at the wave trough, l(n) is the left channel signal at the wave trough, wr is the right channel energy relation coefficient corresponding to the sub-band at the wave trough, and r(n) is the right channel signal at the wave trough.

15. The stereo encoding method according to claim 13, wherein the obtaining the energy sums of the predicted values of the left and right channel signals at the wave trough, by using the first monophonic signal and the left and right channel energy relation coefficients respectively comprises:

$$\text{l_m} = \sum_n m(n) * wl * l(n) \text{ and } \text{r_m} = \sum_n m(n) * wr * r(n),$$

where m(n) is the first monophonic signal at the wave trough, wl is the left channel energy relation coefficient corresponding to a sub-band at the wave trough, and wr is the right channel energy relation coefficient corresponding to the sub-band at the wave trough.

16. The stereo encoding method according to claim 12, wherein the obtaining the scaling factor by using the energy sums of the predicted values of the left and right channel signals and the cross correlation results between the predicted value of the left channel signal and the left channel signal and between the predicted value of the right channel signal and the right channel signal comprises:

calculating a value of an initial scaling factor according to the energy sums and the cross correlation results;

quantizing the value of the initial scaling factor to obtain a quantization index;

determining a search range of the scaling factor in a scaling factor codebook according to the quantization index; and determining an optimal scaling factor within the range.

17. The stereo encoding method according to claim 16, wherein the determining the optimal scaling factor within the range comprises:

calculating prediction error energies respectively according to scaling factors within the range;

selecting a minimum prediction error energy from the prediction error energies; and determining a scaling factor corresponding to the minimum prediction error energy as the optimal scaling factor.

* * * * *